US011801977B1

(12) United States Patent
Gray

(10) Patent No.: US 11,801,977 B1
(45) Date of Patent: Oct. 31, 2023

(54) PACKAGE WITH ONE-PIECE CLOSURE

(71) Applicant: Closure Systems International Inc., Indianapolis, IN (US)

(72) Inventor: Cody A. Gray, Crawfordsville, IN (US)

(73) Assignee: Closure Systems International Inc., Indianapolis, IN (US)

( * ) Notice: Subject to any disclaimer, the term of this patent is extended or adjusted under 35 U.S.C. 154(b) by 0 days.

(21) Appl. No.: 18/061,285

(22) Filed: Dec. 2, 2022

(51) Int. Cl.
*B65D 41/34* (2006.01)
*B65D 47/08* (2006.01)

(52) U.S. Cl.
CPC ..... *B65D 41/3404* (2013.01); *B65D 47/0804* (2013.01); *B65D 2401/25* (2020.05); *B65D 2547/06* (2013.01)

(58) Field of Classification Search
CPC ..... B65D 41/3404; B65D 47/0804; B65D 2401/25; B65D 2401/06
USPC ..... 215/252
See application file for complete search history.

(56) References Cited

U.S. PATENT DOCUMENTS

| | | | | |
|---|---|---|---|---|
| 2,162,880 | A | 6/1939 | Brown | |
| 2,423,582 | A | 7/1947 | Coleman | |
| 3,147,876 | A | 9/1964 | Lepore | |
| 3,160,327 | A | 12/1964 | Porcelli | |
| 3,199,702 | A | 8/1965 | Fischbach | |
| 3,282,477 | A | 11/1966 | Henchert | |
| 3,295,708 | A | 1/1967 | Wathen | |
| 3,405,831 | A | 10/1968 | Hudson | |
| 3,415,403 | A | 12/1968 | Bardell | |
| 3,620,400 | A | 11/1971 | Brown | |
| 3,667,638 | A | 6/1972 | Cambio, Jr. | |
| 3,682,345 | A | 8/1972 | Baugh | |
| 3,741,421 | A | 6/1973 | Wittwer | |
| 3,904,061 | A | 9/1975 | Keeler | |
| 3,987,921 | A | 10/1976 | Aichinger | |
| 4,007,848 | A | 2/1977 | Snyder | |
| 4,053,077 | A * | 10/1977 | DeFelice | B65D 50/043 215/217 |
| RE29,850 | E | 11/1978 | Labarre | |
| 4,171,749 | A | 10/1979 | Obrist | |

(Continued)

FOREIGN PATENT DOCUMENTS

| | | | |
|---|---|---|---|
| EP | 0 008 190 | A1 | 2/1980 |
| GB | 1 052 734 | A | 12/1966 |

(Continued)

*Primary Examiner* — J. Gregory Pickett
*Assistant Examiner* — Niki M Eloshway
(74) *Attorney, Agent, or Firm* — Nixon Peabody LLP

(57) ABSTRACT

A package includes a container and a one-piece closure. The container has a neck portion defining an opening, an external helical thread formation and ratchet catch lugs. The closure fits to the neck portion of the container for closing the opening. The closure includes a first and a second closure portion. The closure includes a top wall portion and an annular skirt portion. The annular skirt portion includes an internal helical thread formation for mating engagement with the external helical thread formation. An interior surface of the annular skirt portion includes helical ratchet teeth threads. At least one of the ratchet catch lugs mechanically catches and locks with a respective one of the helical ratchet teeth threads so as to prevent or inhibit the closure from being removed from the container. The closure opens by flipping via a hinge.

19 Claims, 18 Drawing Sheets

(56) References Cited

U.S. PATENT DOCUMENTS 4,180,175 A 12/1979 Virog
4,345,690 A 8/1982 Hopley
4,345,691 A 8/1982 Burke
4,382,521 A 5/1983 Ostrowsky
4,418,828 A 12/1983 Wilde
4,423,820 A 1/1984 Vangor
4,427,126 A 1/1984 Ostrowsky
4,456,137 A 6/1984 Lyman
4,458,822 A 7/1984 Ostrowsky
4,461,394 A * 7/1984 Sendel ..... B65D 41/0471 215/330
4,470,513 A 9/1984 Ostrowsky
4,497,765 A 2/1985 Wilde
4,505,401 A 3/1985 Berglund
4,506,795 A 3/1985 Herr
4,533,062 A 8/1985 Krautkramer
4,534,480 A 8/1985 Santostasi
4,550,844 A 11/1985 Lininger
4,562,931 A 1/1986 Brach
4,573,601 A 3/1986 Berglund
4,592,476 A 6/1986 Yasada
4,609,115 A 9/1986 Moore
4,630,743 A 12/1986 Wright
4,635,808 A 1/1987 Nolan
4,638,917 A 1/1987 Persch
4,674,643 A 6/1987 Wilde
4,682,702 A 7/1987 Gach
4,697,715 A 10/1987 Beruvides
4,738,730 A 4/1988 Urmston
4,747,502 A 5/1988 Luenser
4,813,561 A 3/1989 Ochs
4,818,828 A 4/1989 Curley
4,938,370 A 7/1990 McBride
4,971,212 A 11/1990 Kusz
4,978,017 A 12/1990 McBride
4,993,570 A 2/1991 Julian
4,997,097 A 3/1991 Krautkramer
5,050,753 A 9/1991 Trump
5,167,335 A 12/1992 McBride
5,184,741 A 2/1993 Chevassus
5,190,177 A 3/1993 Collins
5,197,620 A 3/1993 Gregory
5,205,426 A 4/1993 McBride
5,292,020 A 3/1994 Narin
5,301,849 A 4/1994 Guglielmini
5,307,946 A 5/1994 Molinaro
5,314,085 A 5/1994 Bonet
5,328,044 A 7/1994 Rohrs
5,346,082 A 9/1994 Ochs
5,356,021 A 10/1994 McBride
5,366,774 A 11/1994 Pinto
5,450,972 A 9/1995 Zemlo
5,480,045 A 1/1996 Molinaro
5,501,349 A 3/1996 McCandless
5,564,582 A 10/1996 Kamath
5,588,545 A 12/1996 King
5,676,270 A 10/1997 Roberts
5,715,959 A 2/1998 Pfefferkorn
5,735,426 A 4/1998 Babcock
5,755,360 A 5/1998 Elliott
5,782,369 A 7/1998 Tansey
5,785,209 A 7/1998 Guglielmini
5,797,506 A 8/1998 Lehmkuhl
5,800,764 A 9/1998 Smeyak
5,810,207 A 9/1998 Hayashida
5,829,611 A 11/1998 Beck
5,845,798 A 12/1998 Carrier
5,860,542 A 1/1999 Takamatsu
5,875,942 A 3/1999 Ohmi
5,884,790 A 3/1999 Seidita
5,915,574 A 6/1999 Adams
5,915,579 A 6/1999 Przytulla
5,950,850 A 9/1999 Takamatsu
6,006,930 A 12/1999 Dreyer
6,016,931 A 1/2000 Ohmi
6,044,992 A 4/2000 Ma
6,056,136 A 5/2000 Taber
6,085,921 A 7/2000 Brown
6,089,390 A 7/2000 Druitt
6,109,465 A 8/2000 Henning
6,112,923 A 9/2000 Ma
6,116,445 A 9/2000 Ikemori
6,123,212 A 9/2000 Russell
6,202,872 B1 3/2001 Smeyak
6,247,605 B1 6/2001 Fujie
6,276,543 B1 8/2001 German
6,325,225 B1 12/2001 Druitt
6,371,317 B1 4/2002 Krueger
6,484,896 B2 11/2002 Ma
6,527,132 B1 3/2003 Druitt
6,557,714 B2 5/2003 Babcock
6,574,848 B2 6/2003 Fujie
6,673,298 B2 1/2004 Krueger
6,705,479 B2 3/2004 Druitt
6,776,314 B2 8/2004 Odet
6,779,672 B2 8/2004 Kano
6,793,101 B2 9/2004 Shinozaki
6,889,857 B2 5/2005 Francois
6,991,123 B2 1/2006 Druitt
7,014,055 B2 3/2006 Kano
D530,603 S 10/2006 Lohrman
D547,184 S 7/2007 Kim
7,308,988 B2 12/2007 Yashima
7,344,039 B2 3/2008 Bixler
7,451,898 B2 11/2008 Seidita
D588,915 S 3/2009 Lohrman
7,503,468 B2 3/2009 Druitt
7,607,547 B2 10/2009 Kumata
7,637,384 B2 12/2009 Price
D608,199 S 1/2010 Gross
D610,454 S 2/2010 Lohrman
7,832,579 B2 11/2010 Lohrman
7,942,287 B2 5/2011 King
7,975,864 B2 7/2011 Druitt
8,453,866 B2 6/2013 Kamath
8,485,374 B2 7/2013 Gevers
8,763,380 B2 7/2014 Sata
8,807,360 B2 8/2014 Erspamer
9,085,385 B1 7/2015 Costanzo
9,126,726 B2 9/2015 Edie
D847,633 S 5/2019 Berge
D871,904 S 1/2020 Berge
D871,905 S 1/2020 Kim
10,611,511 B1 * 4/2020 Kuzma ..... B65D 47/08
11,021,302 B2 6/2021 Edie
2001/0011649 A1 8/2001 Fujie
2001/0015355 A1 8/2001 Adams
2001/0027957 A1 10/2001 Kano
2002/0030031 A1 3/2002 Druitt
2002/0066713 A1 6/2002 Ma
2002/0134747 A1 9/2002 Babcock
2003/0116523 A1 6/2003 Druitt
2004/0060893 A1 4/2004 Kano
2004/0065665 A1 4/2004 Mahdi
2004/0155007 A1 8/2004 Hearld
2004/0238478 A1 12/2004 Druitt
2005/0189312 A1 9/2005 Bixler
2006/0163193 A1 7/2006 Smeyak
2006/0255003 A1 11/2006 Fuchs
2007/0125785 A1 6/2007 Robinson
2007/0131641 A1 6/2007 Higgins
2008/0087625 A1 4/2008 Kumata
2009/0045158 A1 2/2009 Suriol
2009/0050648 A1 * 2/2009 Wisniewski ..... B65D 51/226 222/494
2009/0159555 A1 6/2009 Druitt
2011/0011821 A1 1/2011 Lohrman
2012/0312769 A1 * 12/2012 Prozumenschikov ..... B65D 41/3404 215/252
2014/0263149 A1 * 9/2014 Berge ..... B65D 41/3423 215/44

(56) References Cited

U.S. PATENT DOCUMENTS

| | | | |
|---|---|---|---|
| 2017/0349336 | A1 | 12/2017 | Sadiq |
| 2018/0009979 | A1 | 1/2018 | Nishiyama |

FOREIGN PATENT DOCUMENTS

| | | | | |
|---|---|---|---|---|
| GB | 1 054 308 | A | | 1/1967 |
| GB | 2 068 912 | A | | 8/1980 |
| GB | 1 593 072 | | | 7/1981 |
| GB | 2097366 | A | * | 11/1982 |
| GB | 2192385 | A | * | 1/1988 |
| GB | 2 311 060 | A | | 9/1997 |
| JP | 2011-114313 | A | | 6/2011 |
| WO | WO 2002/076839 | A2 | | 10/2002 |
| WO | WO-03086891 | A1 | * | 10/2003 |
| WO | WO 2009/073137 | A1 | | 6/2009 |
| WO | WO-2021042018 | A1 | * | 3/2021 |
| WO | WO-2021080497 | A1 | * | 4/2021 |

* cited by examiner

PACKAGE WITH ONE-PIECE CLOSURE

FIELD OF THE INVENTION

The present invention relates generally to a polymeric closure for a package. More specifically, the present invention relates to a polymeric closure that locks with a container to form a package.

BACKGROUND OF THE INVENTION

Polymeric closures have been used in many applications over the years in conjunction with containers. One type of polymeric closure that has been used with containers is a tamper-evident polymeric closure. Tamper-evident closures are used to prevent or inhibit tampering by providing a visible indication to a user if the closure has been opened.

Some closures are designed to remain locked to a finish of a container. In many of these designs where a closure locks to the container, placing the closure onto the finish of the container is difficult because a large amount of interference occurs between a locking feature of these closures and threads of the finish. It would be desirable to provide a closure that overcomes such problems, while still performing desirable properties of a closure including locking with the container.

SUMMARY

According to one aspect of the present disclosure, a package includes a container and a one-piece closure. The container has a neck portion defining an opening. The neck portion has an exterior surface and an interior surface. The container further includes an external helical thread formation and a plurality of ratchet catch lugs being located on the exterior surface of the neck portion. The plurality of ratchet catch lugs is located further from the opening of the container than the external helical thread formation. The one-piece closure is configured for fitment to the neck portion of the container for closing the opening. The closure includes a first closure portion and a second closure portion. The closure comprises a polymeric top wall portion and a polymeric annular skirt portion. The polymeric annular skirt portion depends from the polymeric top wall portion. The polymeric annular skirt portion includes an internal helical thread formation for mating engagement with the external helical thread formation of the container. An interior surface of the polymeric annular skirt portion includes a plurality of helical ratchet teeth threads. The plurality of helical ratchet teeth threads is located farther from the polymeric top wall portion than the internal helical thread formation. At least one of the plurality of ratchet catch lugs of the container is configured to mechanically catch and lock with a respective one of the plurality of helical ratchet teeth threads so as to prevent or inhibit the closure from being removed from the container. The polymeric closure is adapted to be opened by flipping the first closure portion with respect to the second closure portion via a hinge.

According to a configuration of the above implementation, the container further includes an A-collar. The plurality of ratchet catch lugs is located farther from the opening of the neck portion than the A-collar.

According to another configuration of the above implementation, the plurality of ratchet catch lugs remains at the same distance from the opening of the container.

According to a further configuration of the above implementation, the plurality of ratchet catch lugs extends around a portion of a circumference of the container.

In a further aspect of the above implementation, the plurality of ratchet catch lugs includes a first set and a second set. The first and second sets are on opposite portions of the circumference of the container.

In yet a further aspect of the above implementation, each of the plurality of helical ratchet teeth threads is an angled serrated shape. The plurality of helical ratchet teeth threads may be angled toward rotation of threading occurring between the external helical thread formation of the container and the internal helical thread formation of the closure.

According to a configuration of the above implementation, each of the plurality of helical ratchet teeth threads is angled from about 5 to about 45 degrees, or from about 20 to about 35 degrees.

According to a configuration of the above implementation, a helical pitch of the plurality of helical ratchet teeth threads is from about 1 to about 15 degrees, or from about 3 to about 7 degrees.

According to another configuration of the above implementation, a helical pitch of the plurality of helical ratchet teeth threads and a helical pitch of the external helical thread formation are within about 1.5 degrees of each other, within about 1.0 degrees or each other, or within about 0.5 degrees of each other.

According to a further configuration of the above implementation, the helical pitch of the plurality of helical ratchet teeth threads, the helical pitch of the external helical thread formation, and a helical pitch of the internal helical thread formation are within about 1.0 degrees of each other or within about 0.5 degrees of each other.

According to another aspect of the present disclosure, a package includes a container and a one-piece closure. The container has a neck portion defining an opening. The neck portion has an exterior surface and an interior surface. The container further includes an external helical thread formation and a plurality of ratchet catch lugs being located on the exterior surface of the neck portion. The plurality of ratchet catch lugs is located further from the opening of the container than the external helical thread formation. The one-piece closure is configured for fitment to the neck portion of the container for closing the opening. The closure comprises a first closure portion and a second closure portion. The first closure portion includes a first polymeric top wall portion and a first polymeric annular skirt portion. The first polymeric annular skirt portion depends from the first polymeric top wall portion. The second closure portion includes a second polymeric top wall portion and a second polymeric annular skirt portion depending from the second polymeric top wall portion. The second polymeric top wall portion includes a removable pull ring. The second polymeric annular skirt portion includes an internal helical thread formation for mating engagement with the external helical thread formation of the container. An interior surface of the second polymeric annular skirt portion includes a plurality of helical ratchet teeth threads. The plurality of helical ratchet teeth threads is located farther from the second polymeric top wall portion than the internal helical thread formation. At least one of the plurality of ratchet catch lugs of the container is configured to mechanically catch and lock with a respective one of the plurality of helical ratchet teeth threads so as to prevent or inhibit the closure from being removed from the container. The polymeric closure is adapted to be opened by flipping the first closure portion with respect to the second closure portion via a hinge.

According to a configuration of the above implementation, the first closure portion includes a removable pull ring.

According to another configuration of the above implementation, each of the plurality of helical ratchet teeth threads is an angled serrated shape.

According to a further configuration of the above implementation, a helical pitch of the plurality of helical ratchet teeth threads and a helical pitch of the external helical thread formation are within about 1.5 degrees of each other.

The above summary is not intended to represent each embodiment or every aspect of the present invention. Additional features and benefits of the present invention are apparent from the detailed description and figures set forth below.

BRIEF DESCRIPTION OF THE DRAWINGS

Other advantages of the invention will become apparent upon reading the following detailed description and upon reference to the drawings in which.

Figure 1A:
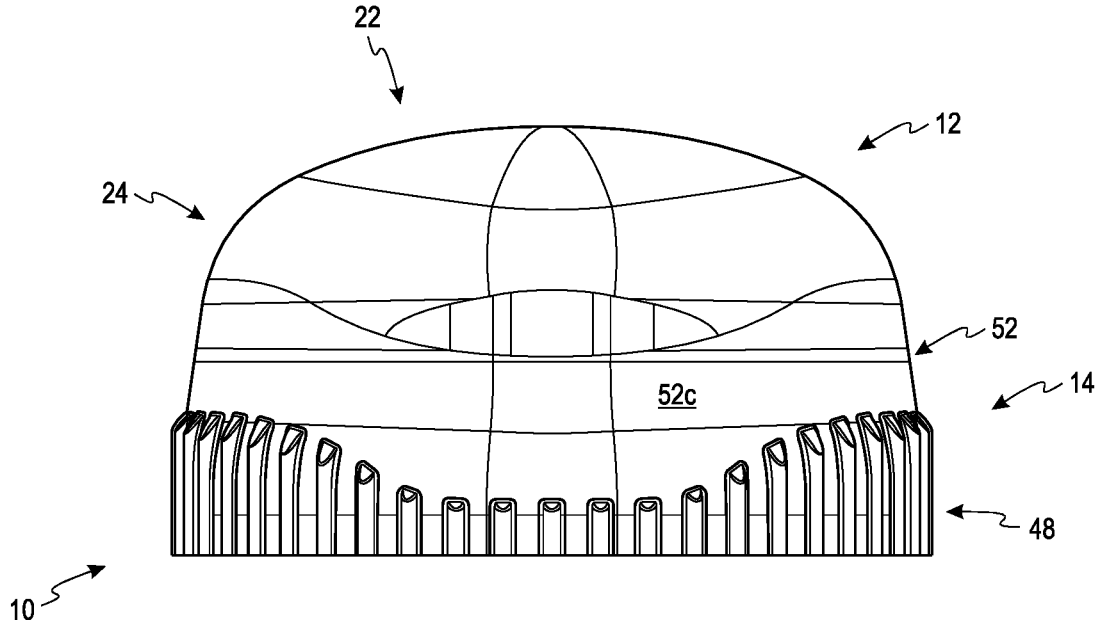
FIG. 1A is a front view of a closure in a closed or unopened position according to one embodiment.

While the invention is susceptible to various modifications and alternative forms, specific embodiments thereof have been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DETAILED DESCRIPTION

Figure 1B:
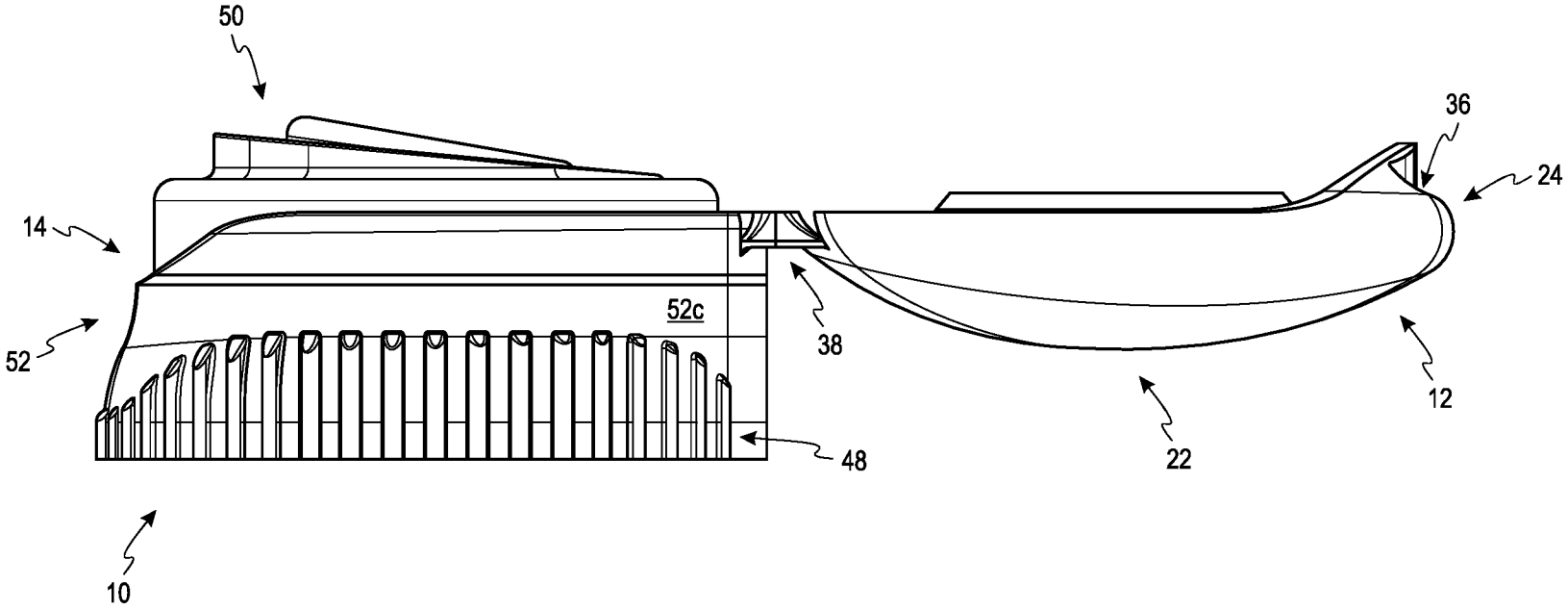
FIG. 1B is a side view of the closure of FIG. 1A in an open position.
Figure 1C:
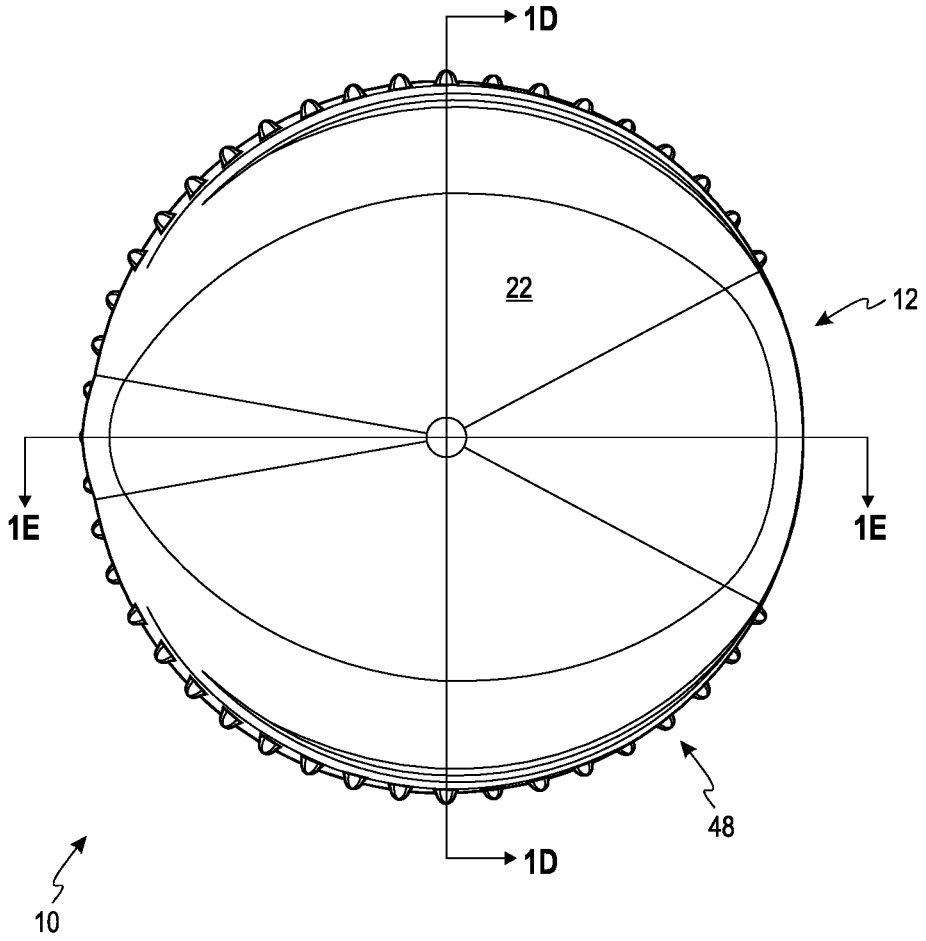
FIG. 1C is a top view of the closure of FIG. 1A.
Figure 1D:
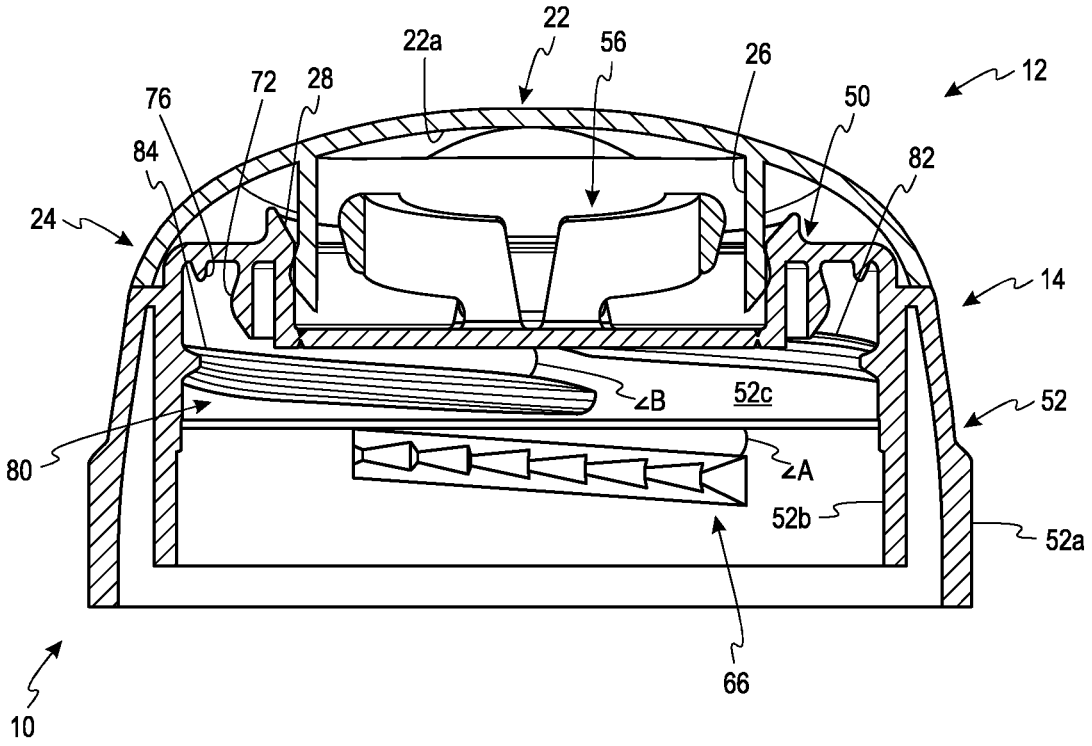
FIG. 1D is a cross-sectional view taken generally along line 1D-1D of the closure of FIG. 1C in a closed position.
Figure 1E:
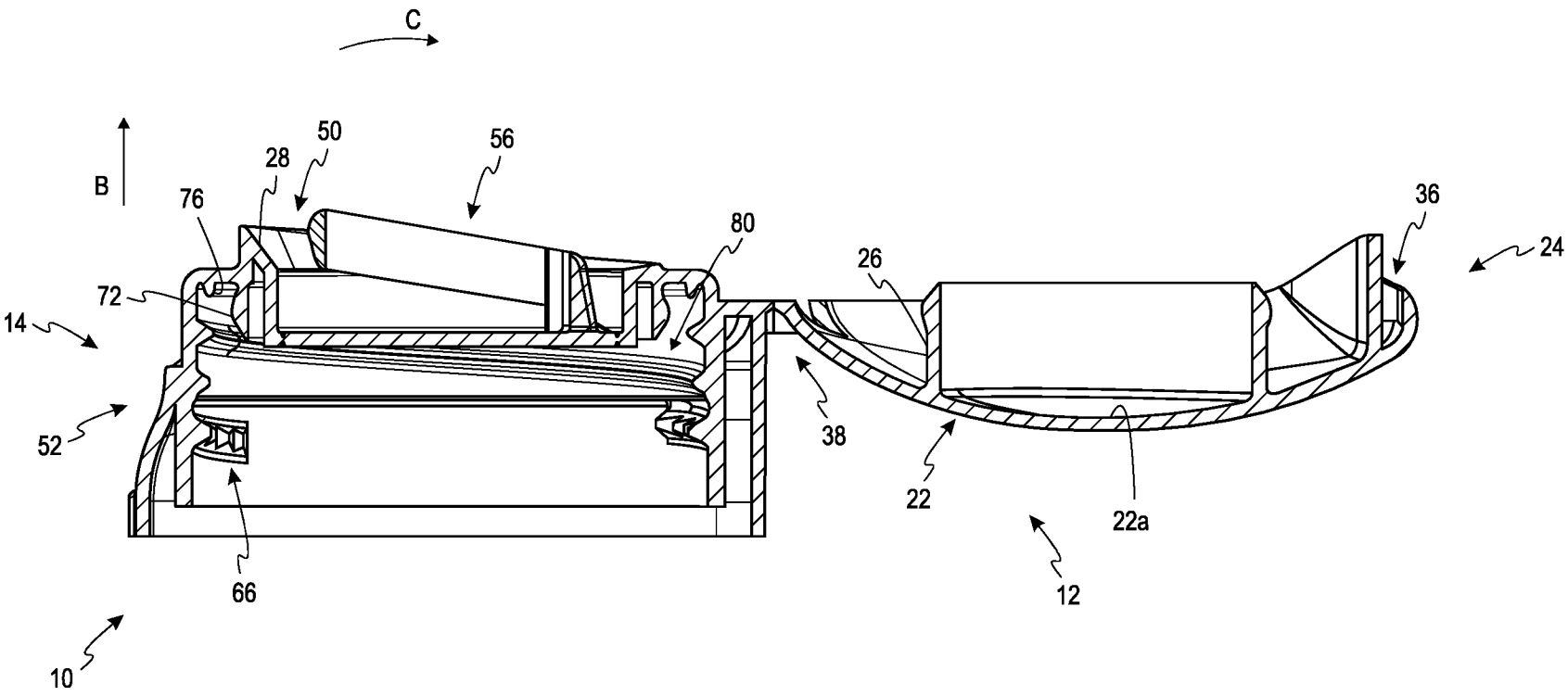
FIG. 1E is a cross-sectional view taken generally along line 1E-1E of the closure of FIG. 1C in an open position.

FIGS. 1A-1F, 2A and 2B illustrate a one-piece polymeric closure 10 according to one embodiment. FIG. 1A illustrates the one-piece polymeric closure 10 in a closed position, while FIG. 1B illustrates the one-piece polymeric closure 10 in an open position. FIGS. 1D and 1E are cross-sectional views in a closed position and an open position of the one-piece polymeric closure 10, respectively. The one-piece polymeric closure 10 is generally cylindrically shaped and is desirably lightweight The one-piece polymeric closures of the present invention are configured to be placed on a container or bottle that contain product. More specifically, the one-piece polymeric closures of the present invention are configured for fitment to a neck portion of the container for closing the opening of the container. A non-limiting example of a container that may be used with the one-piece polymeric closure 10 is shown with a container 108 in FIGS. 3A, 3B. The one-piece polymeric closure 10 is used with the container 108 to form a package 100 according to one embodiment of the present invention. The package 100 is discussed in detail below with respect to FIGS. 4A-4H. FIGS. 4A, 4B show different views of the package 100 with the polymeric closure 10 in a closed position. FIGS. 4C, 4D show cross-sectional views of the package 100 taken generally along line 4C-4C of FIG. 4A with the polymeric closure 10 in a closed position and an open position, respectively. The product contained in the package is typically a liquid product, but also may be a solid product or a combination of a liquid and solid product.

The one-piece polymeric closure is designed to allow the closure to be easily applied to the finish of the container, but which, however, results in the polymeric closure being locked to the container finish. Thus, the one-piece polymeric closure is configured to remain with the container, which reduces environmental waste when the container is recycled.

Referring back to FIGS. 1A-1F, the one-piece polymeric closure 10 includes a first closure portion or lid 12 and a second closure portion or base 14. The first closure portion 12 and the second closure portion 14 are adapted to be flipped with respect to each other via a hinge 38 (see, e.g., FIG. 1B) as will be discussed in detail below. The first closure portion 12 includes a first polymeric top wall portion 22 and a first polymeric annular skirt portion 24. The first polymeric annular skirt portion 24 depends from the first polymeric top wall portion 22. As shown best in FIG. 1B, the second closure portion 14 includes a second polymeric top wall portion 50 and a second polymeric annular skirt portion 52. The second polymeric annular skirt portion 52 depends from the second polymeric top wall portion 50.

Figure 2A:
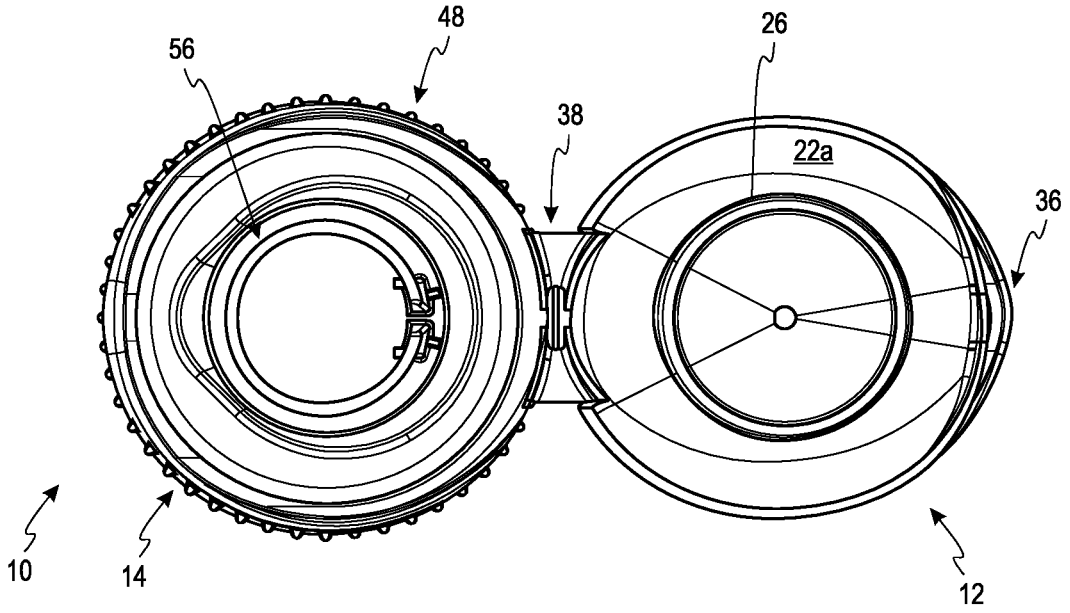
FIG. 2A is a top view of the closure in FIG. 1A in an open position.
Figure 3A:
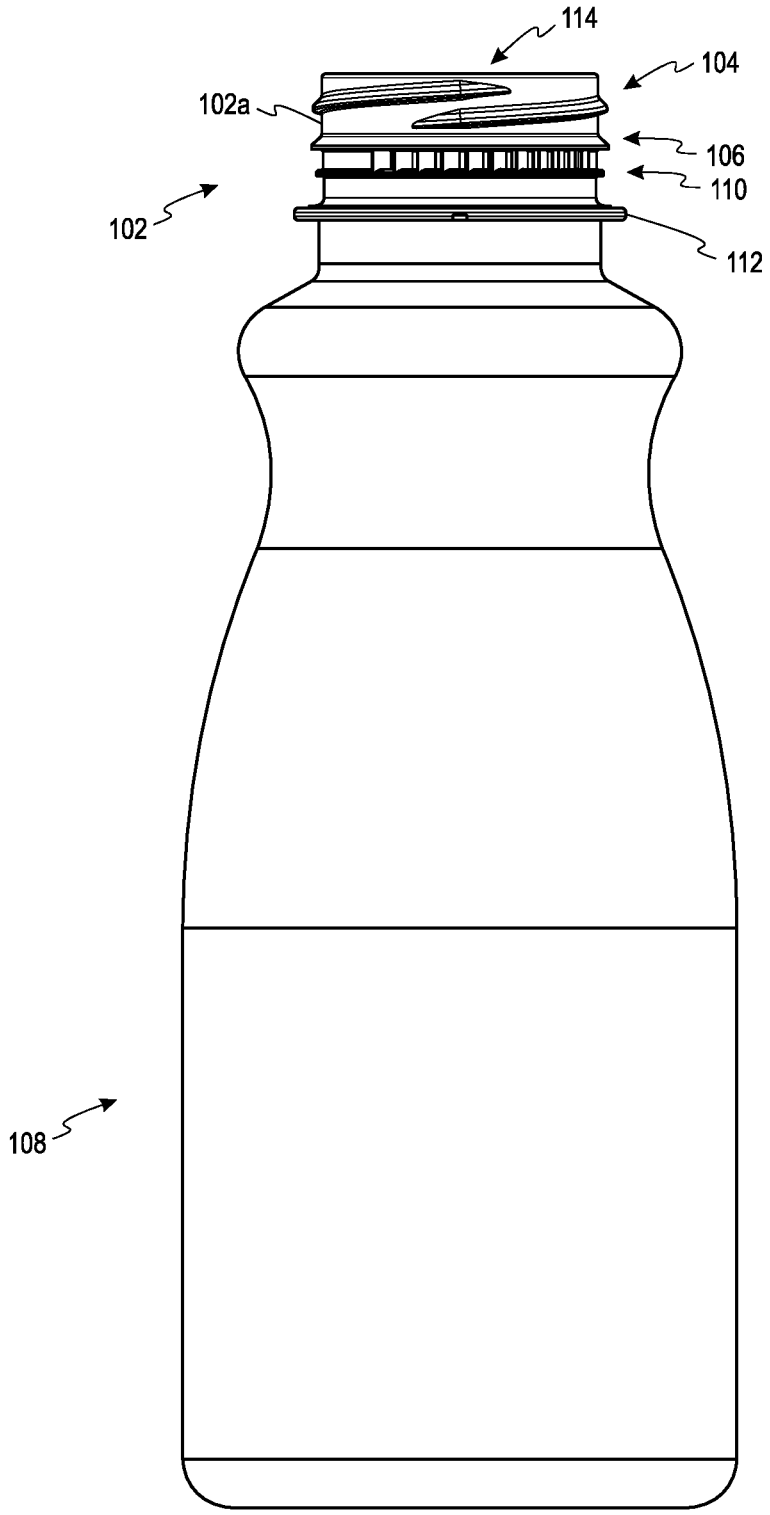
FIG. 3A is a front view of a container according to one embodiment.

Referring to FIGS. 1D and 2A, the first polymeric top wall portion 22 includes a continuous wedge seal 26 extending from an inner surface 22*a* of the polymeric top wall portion 22 thereof according to one embodiment. The continuous wedge seal 26 works in conjunction with a slanted extension 28 of the second closure portion 14 to form a continuous wedge seal (see FIG. 1D). The continuous wedge seal 26 and the slanted extension 28 provide sealing to prevent or inhibit air or moisture from reaching the contents of the container 108 after a removable pull ring 56 is removed, which will be discussed below with respect to FIG. 4G. The continuous wedge seal 26 is sized and located such that a sufficient seal is formed with the slanted extension 28 of the second closure portion 14.

To assist a user in opening the first closure portion 12 with respect to the second closure portion 14, the first polymeric annular skirt portion 24 includes a lift extension 36 as shown in FIGS. 1B, 2A. The lift extension 36 of FIGS. 1B, 2A is shaped and sized for a user to grasp when opening the polymeric closure 10. The lift extension 36 is typically located opposite of the hinge 38.

Referring to, for example, FIGS. 1A, 1B and 2A, the second polymeric annular skirt portion 52 includes a plurality of knurls 48 formed on an exterior surface 52*c* thereof. In one embodiment, the plurality of knurls 48 is compatible and cooperates with a gripper chuck. The gripper chuck (not shown) provides a top load and a rotational load onto the polymeric closure when placing a closure onto a container. The plurality of knurls 48 aligns with the inside of the gripper chuck and assists in providing a balanced load onto the closure in one embodiment.

Figure 2B:
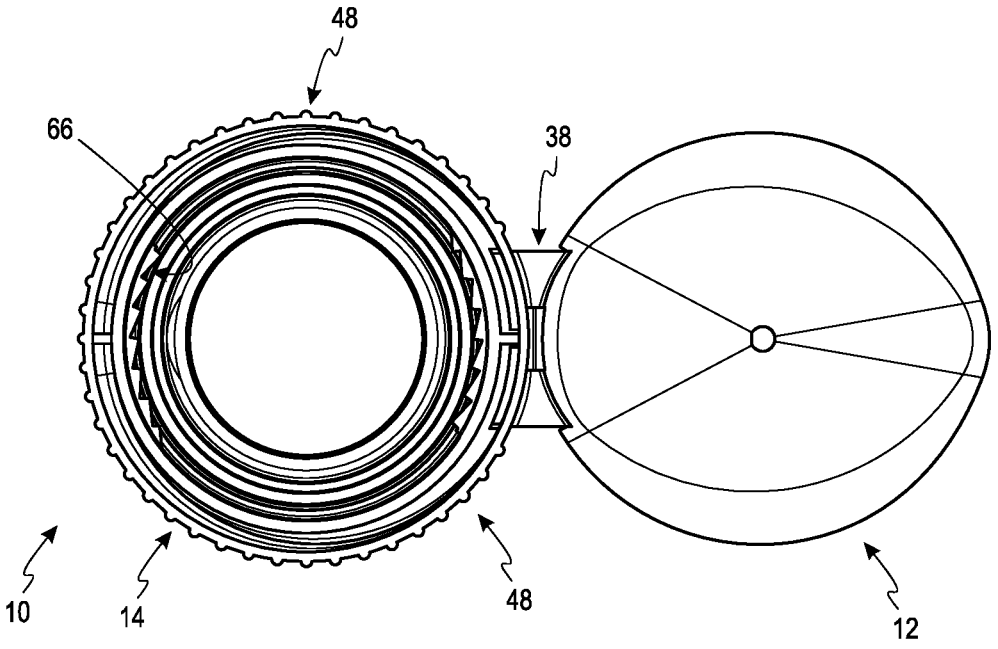
FIG. 2B is a bottom view of the closure in FIG. 1A in an open position.

The plurality of knurls 48 extends substantially around the entire periphery of the second polymeric annular skirt portion 52 as best shown in FIGS. 2A, 2B. The plurality of knurls in this embodiment is not located directly underneath the hinge 38. It is contemplated that the plurality of knurls may extend around less than the entire periphery of the second polymeric annular skirt portion. In one embodiment, the plurality of knurls extends generally around the second polymeric annular skirt portion. In another embodiment, the plurality of knurls extends substantially around the second polymeric annular skirt portion. It is contemplated that the size and shape of the knurls may be different than shown in, for example, FIGS. 1A, 1B, 2A. The knurls in this embodiment, however, should be desirably configured for compatibility to a gripper chuck.

Referring back to FIGS. 1D, 2A, the second closure portion 14 includes the second polymeric top wall portion 50 and the second polymeric annular skirt portion 52. The second polymeric annular skirt portion 52 is a double walled-structure that includes a first annular outer wall 52*a* and a second annular inner wall 52*b*. The second polymeric top wall portion 50 includes the removable pull ring 56. The removable pull ring 56 is a tamper-evident feature in the one-piece polymeric closure 10. A top view of the removable pull ring 56 is shown in its initial position in the polymeric closure 10 in FIG. 2A. The removable pull ring 56 is configured to be removed such that a user may gain access to the contents of the container 108.

Figure 4A:
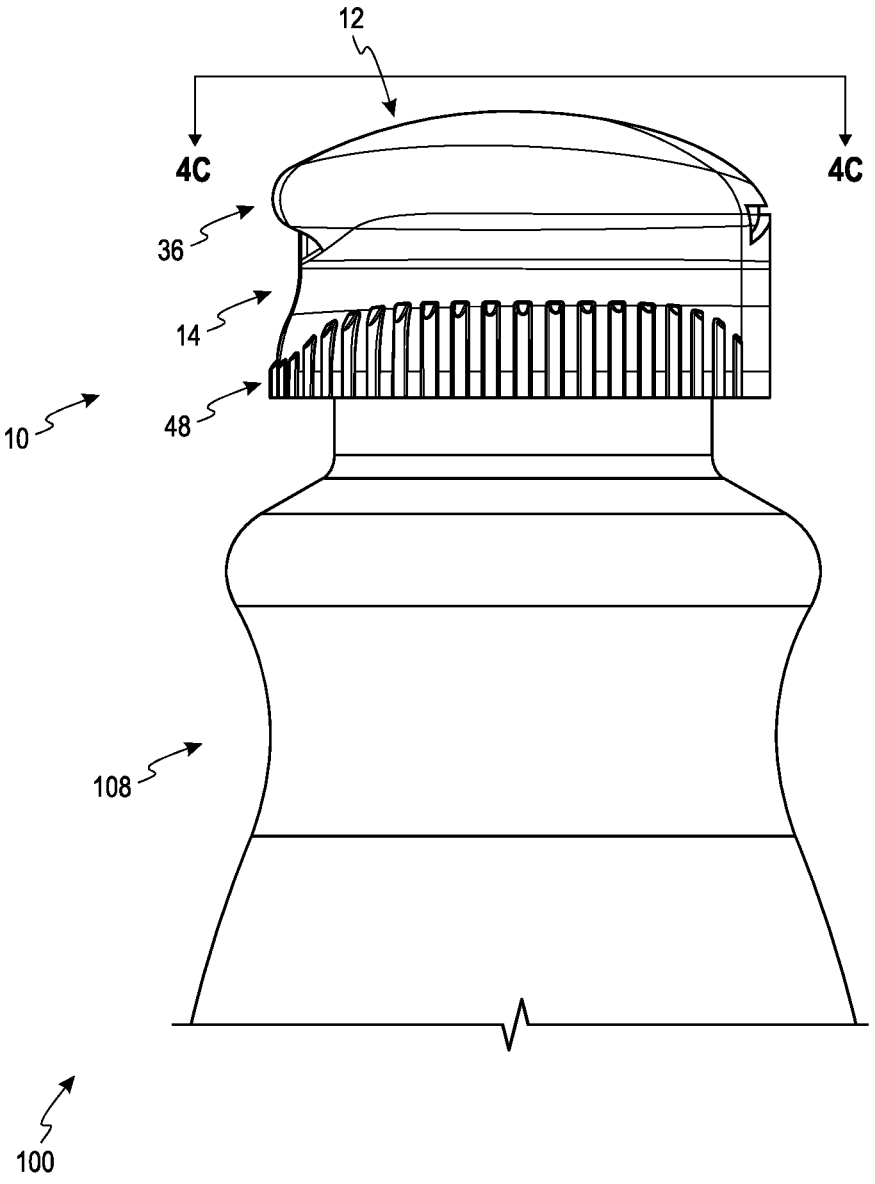
FIG. 4A is a side view of a package including the closure of FIG. 1A and the container of FIG. 3A in a closed position.
Figure 4B:
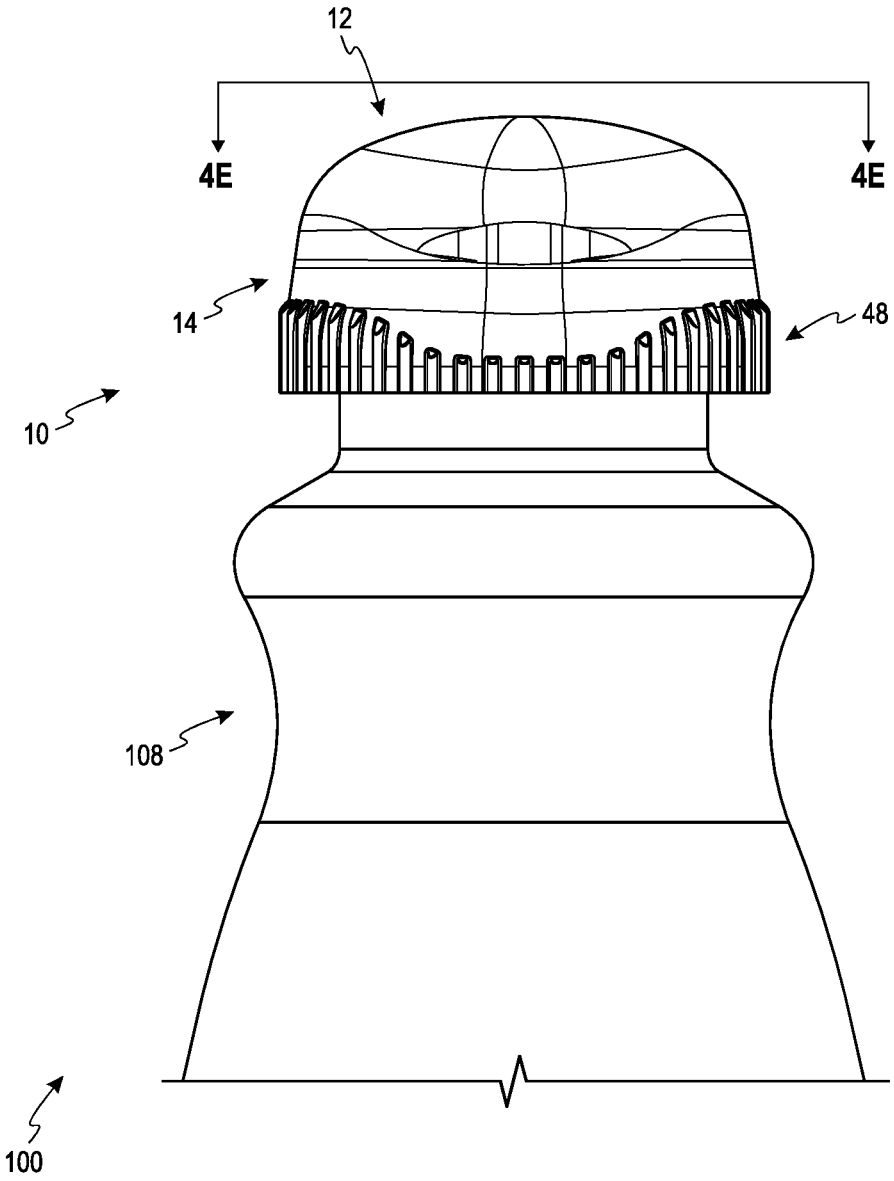
FIG. 4B is a front view of the package of FIG. 4A.
Figure 4C:
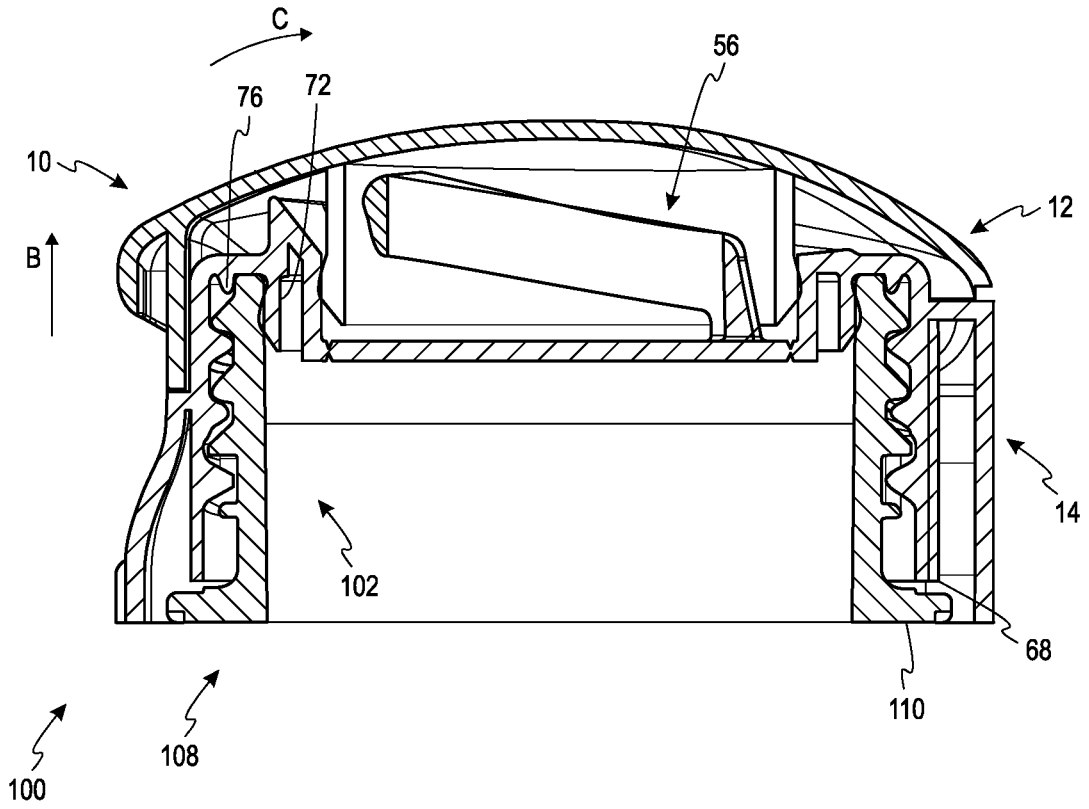
FIG. 4C is a cross-sectional view taken generally along line 4C-4C of the package of FIG. 4A in a closed position.
Figure 4D:
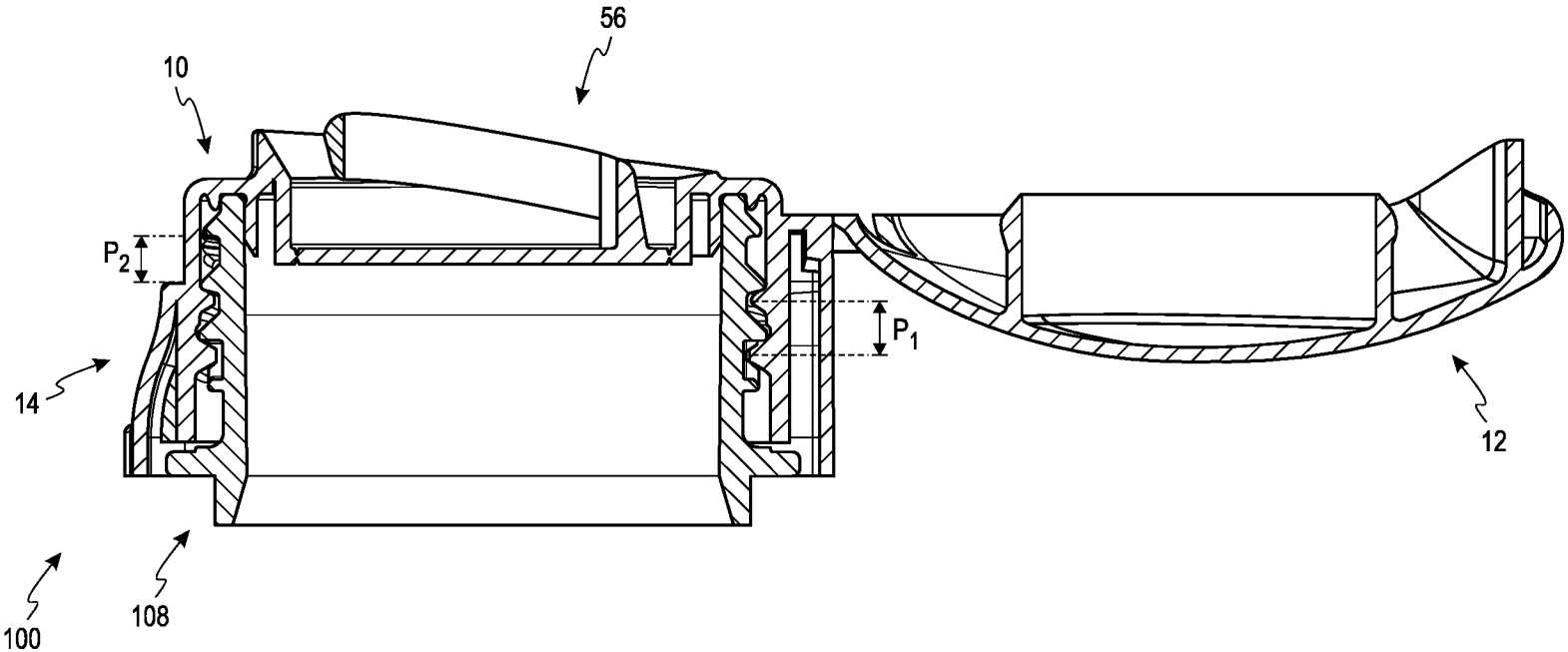
FIG. 4D is a cross-sectional view taken generally along line 4C-4C of the package of FIG. 4A in an open position.
Figure 4E:
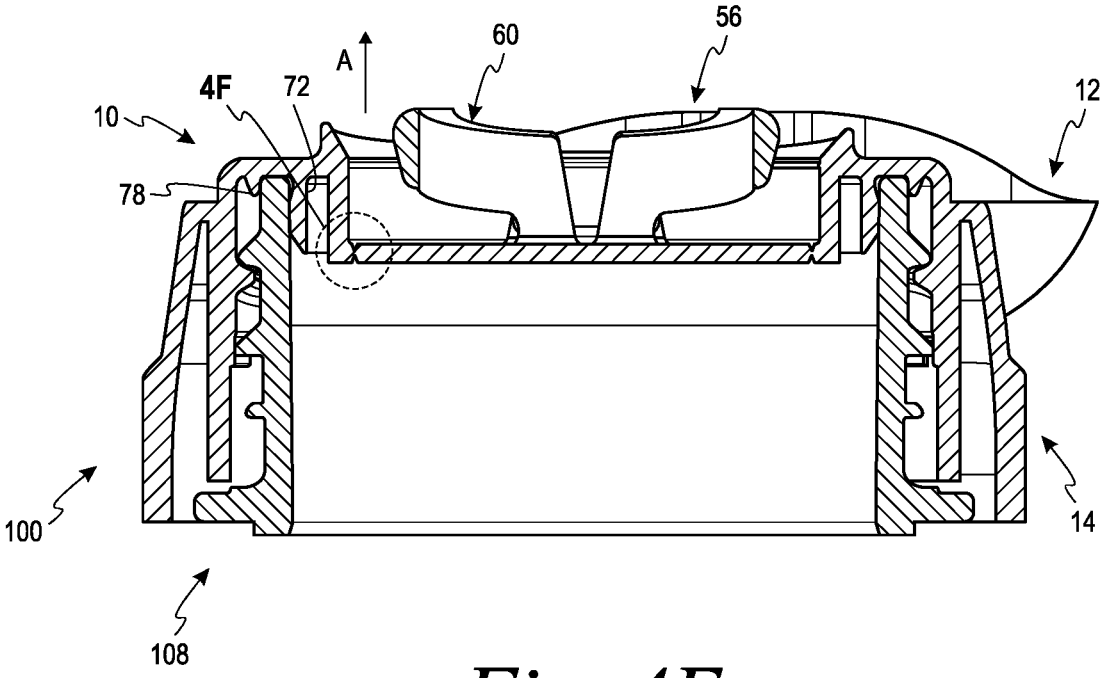
FIG. 4E is a cross-sectional view taken generally along line 4E-4E of the package of FIG. 4B in an open position.
Figure 4F:
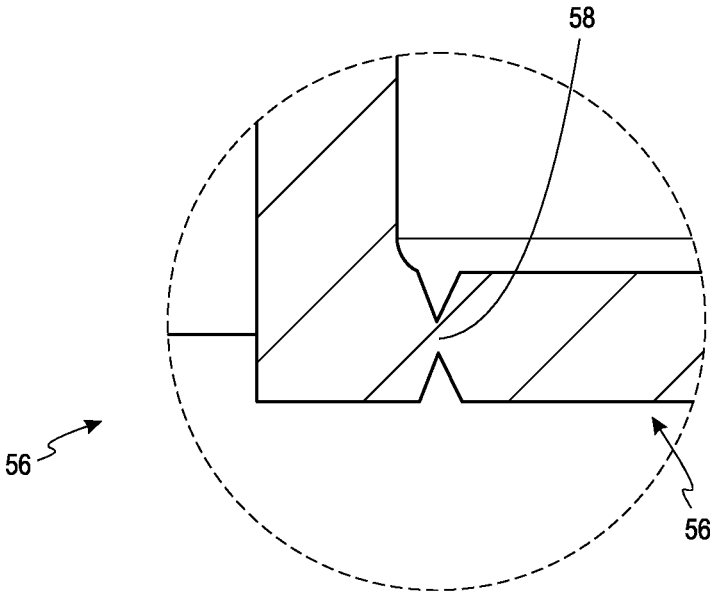
FIG. 4F is an enlarged cross-sectional view of the generally circular area 4F in FIG. 4E showing a thinned tearable section according to one embodiment.
Figure 4G:
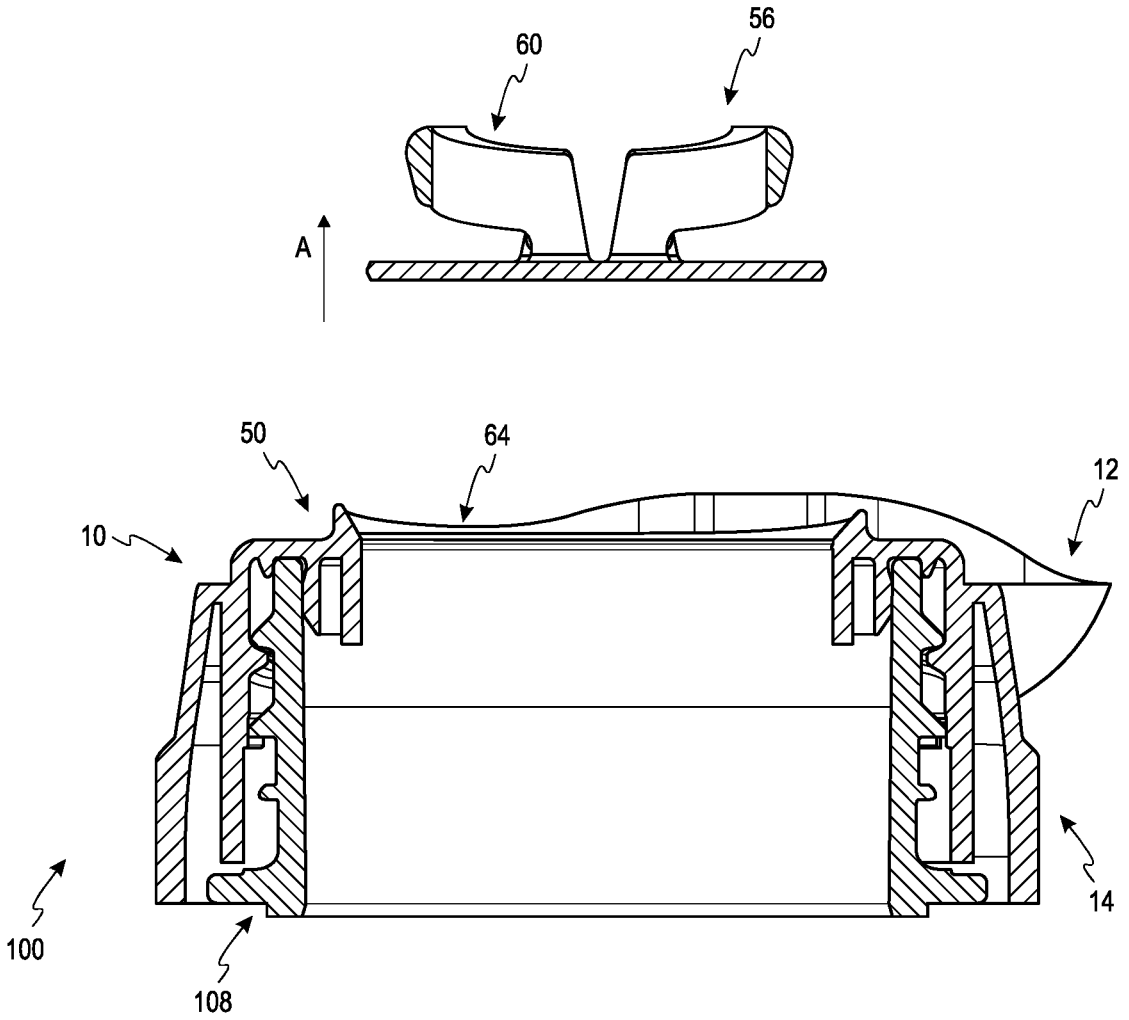
FIG. 4G is the generally cross-sectional view of FIG. 4E after the removable pull ring has been removed.

Referring to FIGS. 4E-4G, the removable pull ring 56 is configured to be removed from the remainder of the polymeric closure 10 in this embodiment using a thinned tearable section 58. The thinned tearable section 58 generally has from about 5 to about 30 percent of the thickness of the remainder of the removable pull ring 56. This assists the user in removing the removable pull ring 56 without an undue force, while still preventing or inhibiting inadvertent removal of the removable pull ring 56. To remove the pull ring, a user grasps the removable pull ring 56 (see FIG. 4E) and, more specifically, grasps a ring portion 60 of the removable pull ring 56. After grasping the ring portion 60, the user pulls in the general direction of Arrow A with sufficient force to break the thinned tearable section 58 that extends around the perimeter of the removable pull ring 56. FIG. 4G depicts the one-piece polymeric closure 10 after the removable pull ring 56 has been removed from the one-piece polymeric closure 10.

After the removable pull ring 56 is removed in FIG. 4G, an opening 64 in the second polymeric top wall portion 50 is formed. This opening 64 allows a user to gain access to the contents of the container 108. The shape of the opening 64 is generally circular. This shape, for example, assists a user in allowing the contents to be smoothly and controllable poured or accessed from the container. It is contemplated that the shape and size of the opening formed by the removal of the removable pull tab may be different. Other non-limiting examples of the opening include, but are not limited to, an oval shape or a tear-dropped shape.

Referring back to FIGS. 1D-1F and 2B, the second polymeric annular skirt portion 52 of the polymeric closure 10 includes an internal helical thread formation 80 for mating engagement with an external helical thread formation 104 of the container 108. The internal helical thread formation 80 is a helical shape. The internal helical thread formation 80 includes a first closure lead 82 and a second closure lead 84. The first and second closure leads 82, 84 are referred collectively as a double lead closure thread. Each of the first and second closure leads 82, 84 is continuous. The first positions of the first and second closure leads 82, 84 may be located roughly 180 degrees apart from each other and, thus, begin on generally opposing sides of the one-piece polymeric closure 10.

It is contemplated that the first and second closure leads may be discontinuous. It is also contemplated that other internal helical thread formations may be used in the closure. For example, the internal helical thread formation may include a triple-threaded structure having first, second and third closure leads.

Figure 1F:
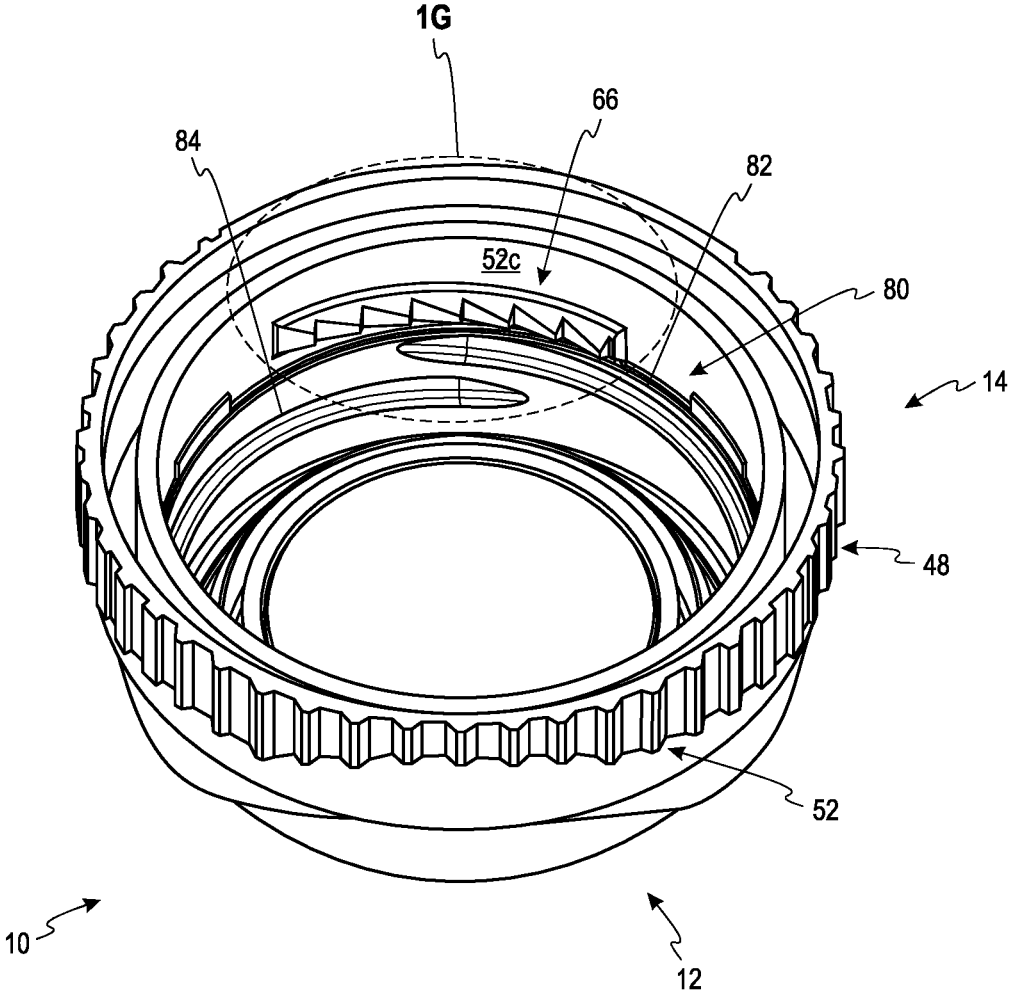
FIG. 1F is a bottom perspective view of the closure of FIG. 1A.

Referring still to FIGS. 1D-1F and 2B, an interior surface 52*c* of the second polymeric annular skirt portion 52 (second annular inner wall 52*b*) includes a plurality of helical ratchet teeth threads 66. As shown best in FIG. 1D, the plurality of helical ratchet teeth threads 66 is located farther from both the first polymeric top wall portion 22 and the second polymeric top wall portion 50 than the internal helical thread formation 80. Referring to FIG. 1F, the plurality of helical ratchet teeth threads 66 is shown as an angled serrated or jagged shape. The plurality of helical ratchet teeth threads 66 extends from the interior surface 52*c* and is angled toward the threading rotation so as to prevent or inhibit unthreading. In this embodiment, the threading would be performed in a counterclockwise manner. The angle of one of the plurality of helical ratchet teeth threads 66 is shown as angle D in FIG. 1F. The angle D is from about 5 to about 45 degrees in one embodiment. In another embodiment, the angle D is from about 5 to about 40 degrees, or from about 10 to about 40 degrees. In a further embodiment, the angle D is from about 10 to about 35 degrees, or from about 20 to about 35 degrees.

Figure 1G:
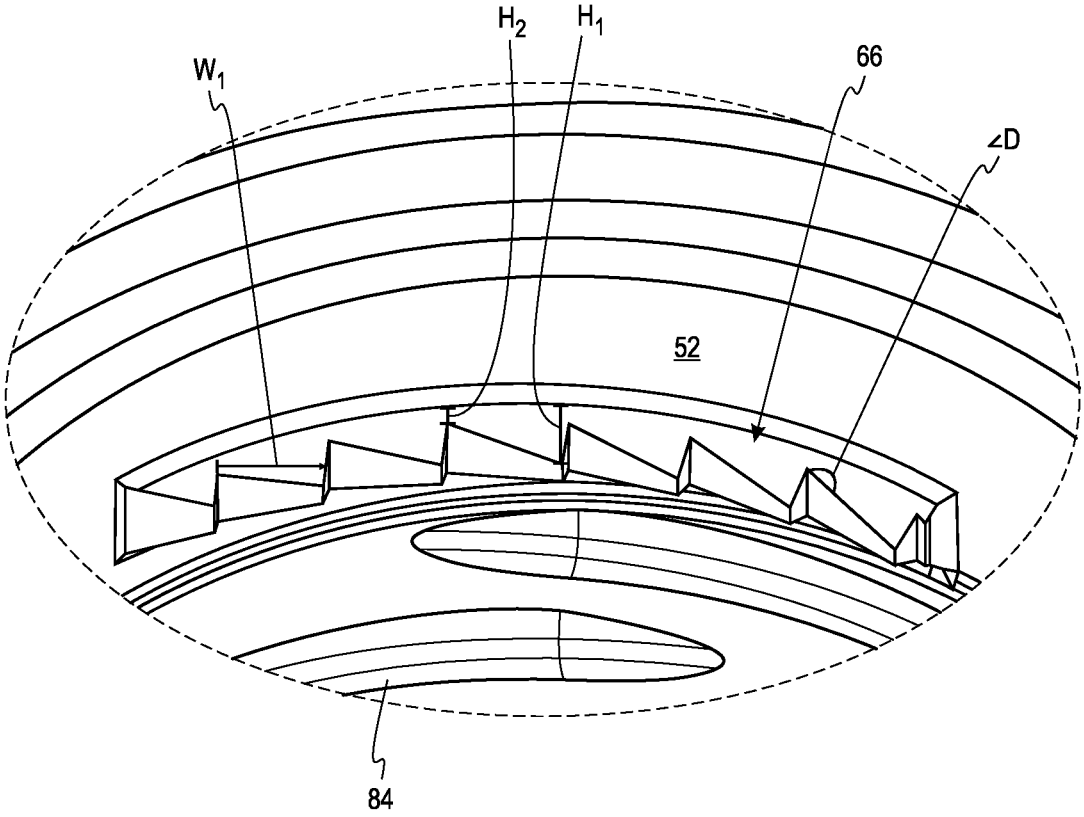
FIG. 1G is an enlarged view of a generally oval area of FIG. 1F.

The height and depth of the plurality of helical ratchet teeth threads 66 can vary. Referring to FIG. 1G, a height H1, a height H2, and a depth D1 are shown on the plurality of helical ratchet teeth threads 66. The height of the helical ratchet teeth threads 66 is angled and includes the height is varied from the height H2 to the height H1. The height H1 is greater than the height H2 and, thus, is a greatest distance from the interior surface 52*c*.

The height H1 is generally from about 0.04 inch to about 0.08 inch and, more specifically, from about 0.05 inch to about 0.07 inch. The depth D1 is generally from about 0.04 inch to about 0.08 inch and, more specifically, from about 0.05 inch to about 0.07 inch. The size of the plurality of helical ratchet teeth threads is dependent and corresponds with the size of the ratchet cut lugs on the finish of the container.

Figure 4H:
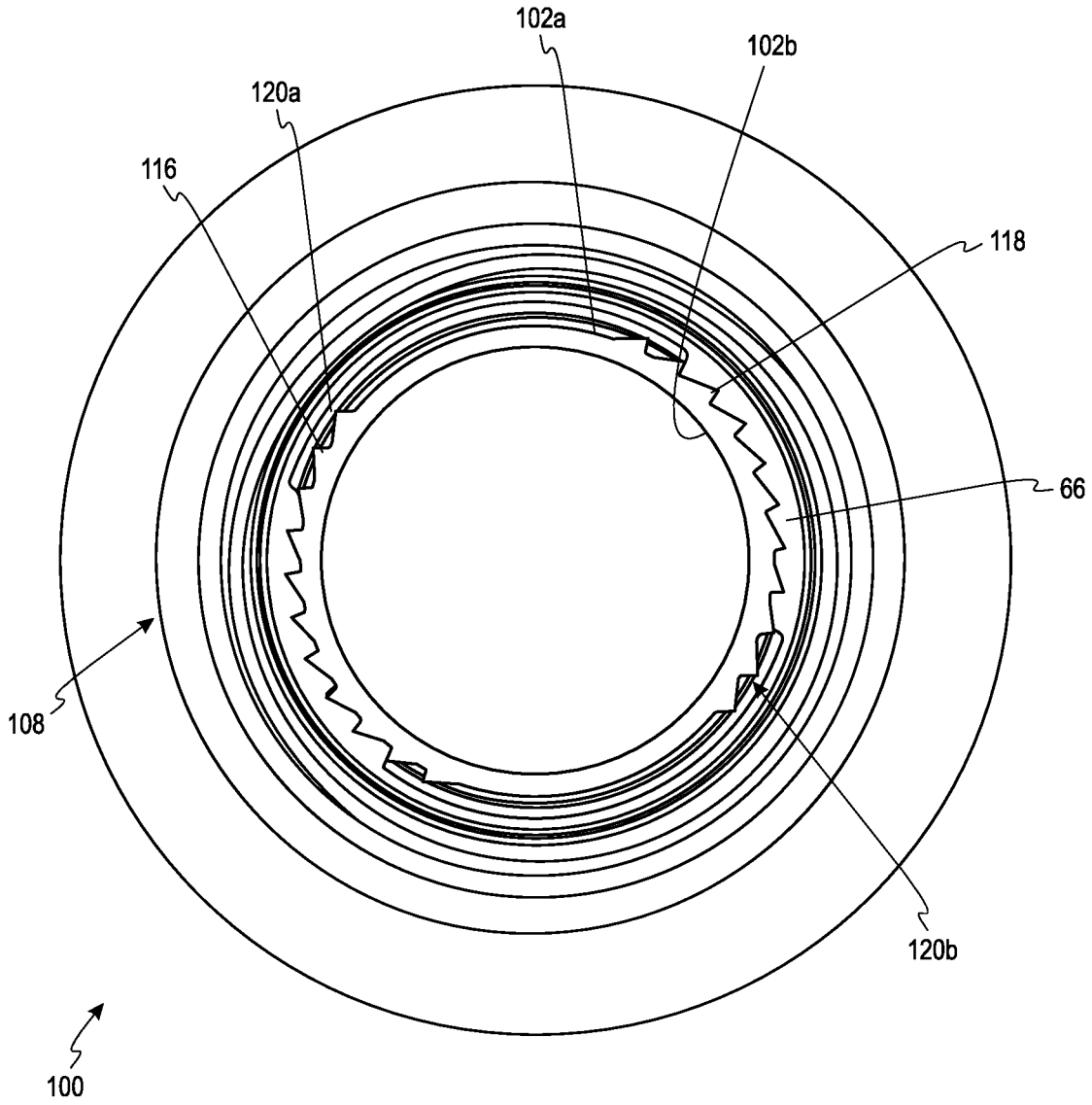
FIG. 4H is a bottom view of the package of FIG. 4A.
Figure 5:
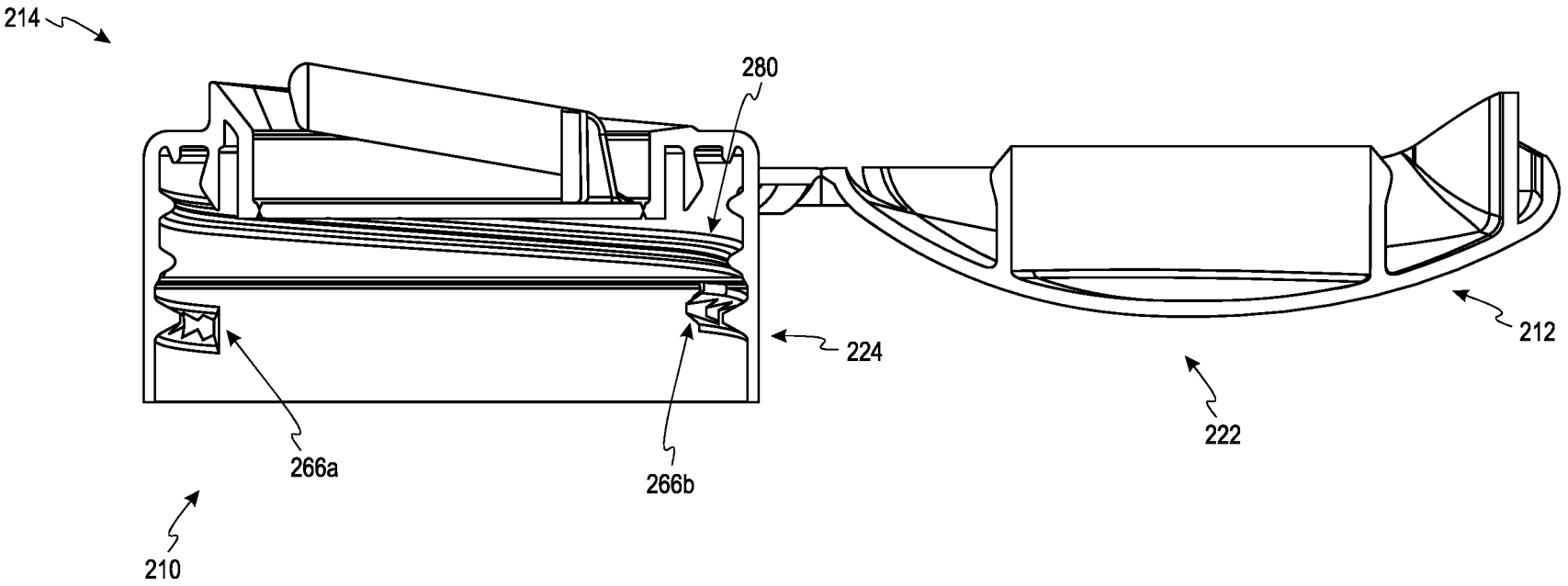
FIG. 5 is a cross-sectional view of a closure according to another embodiment with a finish of a container.

Specifically, as will be discussed below with respect to FIG. 4H, at least one of the plurality of helical ratchet teeth threads 66 is configured to mechanically catch and lock with a respective one of a plurality of ratchet catch lugs 116 of the container 108 so as to prevent or inhibit the one-piece polymeric closure 10 from being removed from the container. Thus, a user cannot unscrew the one-piece polymeric closure 10 from the neck portion or finish 102 of the container 108 to gain access to the contents therein when at least one of the helical ratchet teeth threads 66 locks with a respective one of the plurality of ratchet catch lugs 116 of the container 108. The angled shape of the plurality of helical ratchet teeth threads 66 assists in preventing or inhibiting the user from unthreading the closure 10 from the container 108. It is desirable for more than one of the helical ratchet teeth threads 66 to each lock with a respective one of the plurality of ratchet catch lugs 116 of the container 108. This is shown in FIG. 4H, for example, which will be discussed below.

Therefore, the plurality of ratchet catch lugs 116 of the container 108 and the plurality of helical ratchet teeth threads 66 form a tamper-evident feature that prevents or inhibits a user from gaining access to the contents of the container 108 by attempting to unscrew the one-piece polymeric closure 10 from the container 108.

The plurality of helical ratchet teeth threads 66 as shown in FIG. 1D is shown in a first set with exactly seven threads. The number of helical ratchet teeth threads may vary in a set, as well as the number of sets may vary. In the one-piece polymeric closure 10, the plurality of helical ratchet teeth threads has exactly two sets as shown best in FIG. 1E in which the second set is the same as the first set and is located on opposite sides of the polymeric closure 10. It is contemplated that the plurality of helical ratchet teeth threads may include a plurality of sets or may include exactly one set.

Referring back to FIG. 1D, the plurality of helical ratchet teeth threads 66 has a helical pitch in a downwardly direction (as viewed from the top wall portion) and is measured by angle A. The helical pitch of the helical ratchet teeth threads 66 is generally from about 1 to about 15 degrees as measured by angle A (shown in FIG. 1D). More specifically, the helical pitch of the helical ratchet teeth threads 66 is from about 2 to about 15 degrees, or from about 3 to about 10 degrees as measured by angle A shown in FIG. 1D. The helical pitch of the helical ratchet teeth threads 66 in further embodiments is from about 2 to about 8 degrees, or from about 3 to about 7 degrees as measured by angle A shown in FIG. 1D.

Referring still to FIG. 1D, the internal helical thread formation 80 of the polymeric closure 10 has a helical pitch in a downwardly direction (as viewed from the top wall portion) and is measured by angle B. The helical pitch of the internal helical thread formation 80 is generally from about 1 to about 15 degrees as measured by angle B (shown in FIG. 1D). More specifically, the helical pitch of the internal helical thread formation 80 is from about 2 to about 15 degrees, or from about 3 to about 10 degrees as measured by angle B shown in FIG. 1D. The helical pitch of the internal helical thread formation 80 in further embodiments is from about 2 to about 8 degrees, or from about 3 to about 7 degrees as measured by angle B shown in FIG. 1D.

Figure 3B:
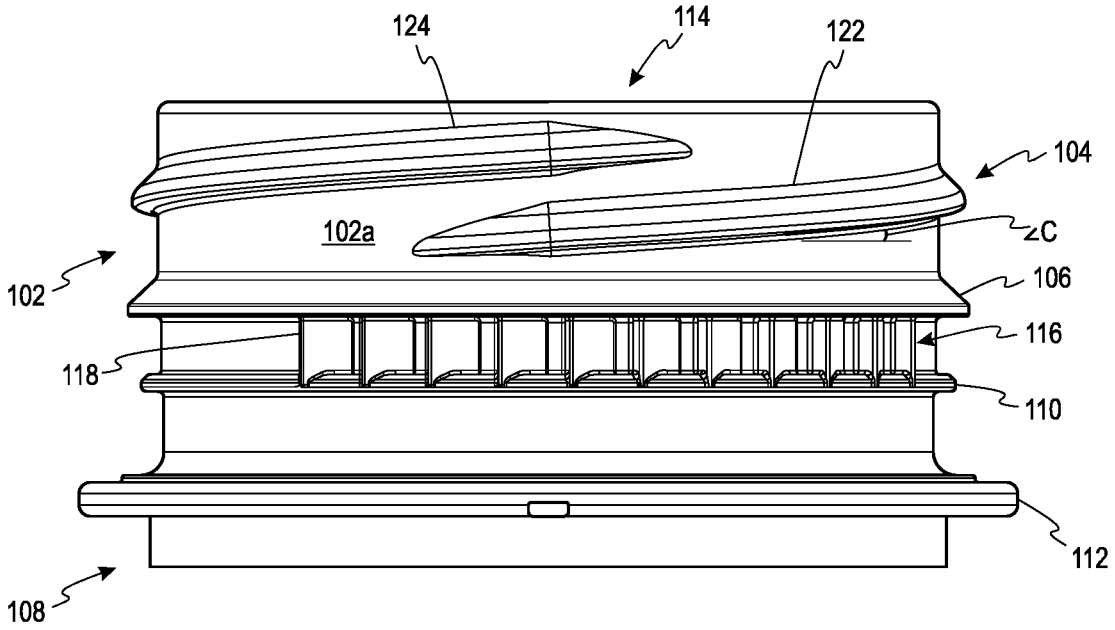
FIG. 3B is an enlarged view of a finish of the container of FIG. 3A.

Referring to FIG. 3B, the external helical thread formation 104 of the container 108 has a helical pitch in a downwardly direction (as viewed from the opening 114). The helical pitch of the external helical thread formation 104 is generally from about 2 to about 15 degrees, or from about 3 to about 10 degrees as measured by angle C shown in FIG. 3B. The helical pitch of the external helical thread formation 104 in further embodiments is from about 2 to about 8 degrees, or from about 3 to about 7 degrees as measured by angle C shown in FIG. 3B.

In one embodiment, the plurality of helical ratchet teeth threads 66 has the same or similar helical pitches as the external helical thread formation 104 of the container 108. For example, the helical pitches of the plurality of helical ratchet teeth threads 66 and the external helical thread formation 104 of the container 108 are desirably within 1.5 or 1 degrees of each other. This is shown, for example, by comparing angles A and C in FIGS. 1D and 3B, respectively. It is more desirable that the helical pitches of the plurality of helical ratchet teeth threads 66 and the external helical thread formation 104 of the container 108 are within 0.5 degrees or are the same as each other.

In another embodiment, the plurality of helical ratchet teeth threads 66 has the same or similar helical pitch as the internal helical thread formation 80 of the polymeric closure 10. For example, the helical pitches of the plurality of helical ratchet teeth threads 66 and the internal helical thread formation 80 of the polymeric closure 10 are desirably within 1.5 or 1 degrees of each other. This is shown, for example, by comparing angles B and C in FIGS. 1D and 3B, respectively. It is more desirable that the helical pitches of the plurality of helical ratchet teeth threads 66 and the internal helical thread formation 80 of the polymeric closure 10 are within 0.5 degrees or are the same as each other.

Referring to FIG. 4D, a pitch P1 of the internal helical thread formation 80 of the polymeric closure 10 is shown, as well as a pitch P2 of the external helical thread formation 104 of the container 108. A pitch is an axial distance of a full revolution around the circumference of the closure or the container. The pitch P1 of the internal helical thread formation 80 is from about 0.1 inch to about 0.3 inch and, more specifically, from about 0.2 inch to about 0.3 inch. The pitch P2 of the external helical thread formation 104 is from about 0.1 inch to about 0.3 inch and, more specifically, from about 0.2 inch to about 0.3 inch. The pitch of the helical ratchet teeth threads 66 is from about 0.1 inch to about 0.3 inch and, more specifically, from about 0.2 inch to about 0.3 inch.

The plurality of helical ratchet teeth threads 66 desirably has the same or similar helical pitch as the external helical thread formation 104 of the container 108. It is also desirable for the plurality of helical ratchet teeth threads 66 to have the same or similar helical pitch as the internal helical thread formation 80 of the polymeric closure 10. By having the same or similar helical configuration as at least the external helical thread formation, this allows the polymeric closure 10 to be applied more effortlessly up to the point that the ratchet teeth threads contact an A diameter (in which the external and internal helical thread formations are engaged) and until the ratchet teeth threads are applied to the ratchet catch lugs of the finish.

The helical ratchet teeth threads 66 assists in allowing the one-piece polymeric closure 10 to be applied easily onto the neck portion 102 of the container 108. The helical ratchet teeth threads are able to be applied easily because of the lack of interferences with the external helical thread formation of the container. The lack of interferences occurs because the helical ratchet teeth threads have the same or similar pitch as the external helical thread formation of the container.

Referring back to FIG. 4C, the second polymeric annular skirt portion 52 forms an undercut 68 that corresponds and receives a transfer collar 110 of the container 108. The undercut 68 and the transfer collar 110 are in an abutting relationship with each other. The undercut 68 and the transfer collar 110 assist in transferring and distributing the loads applied by the gripper chuck.

Referring back to FIG. 1D, the second closure portion 14 further includes a polymeric continuous plug seal 72 and a polymeric outer seal 76. The polymeric continuous plug seal 72 and the outer seal 76 depend from the second polymeric top wall portion 50, and provide a sealing mechanism. The continuous plug seal 72 provides an inner seal with an inner finish surface of the container 108. The outer seal 76 provides an outer seal with respect to an outer finish surface of the container 108. This is shown, for example, in FIGS. 4C, 4E.

In another embodiment, the polymeric closure may include other sealing mechanisms. For example, the closure may include only a polymeric outer seal or a polymeric continuous plug seal. It is contemplated that the polymeric closure may include other sealing mechanisms. For example, a top seal may be added with respect to an outer top finish surface of the container to assist in forming another seal. The top seal, if added in this embodiment, would be located between the continuous plug seal 72 and the outer seal 76.

The container 108 is shown in FIGS. 3A, 3B. The container 108 is used with the one-piece polymeric closure 10 in one embodiment. The container 108 includes a neck portion 102 that defines an opening 114. The neck portion 102 has an exterior surface 102*a* and an interior surface 102*b* as shown in FIGS. 3B and 4H. The neck portion 102 of the container 108 includes an external helical thread formation 104, an A-collar 106, a circumferential bead 110, and a support ledge 112. The A-collar 106 prevents or inhibits the one-piece polymeric closure 10 from being lifting upwardly and away from the container 108. The support ledge 112 assists in holding a bottle when applying the closure. The support ledge may include a notch to assist in identifying the location where to start the threads.

The external helical thread formation 104 of the container 108 includes a first finish lead 122 and a second finish lead 124. The external helical thread formation 104 (finish leads 122, 124) engages with the corresponding internal helical thread formation 80 (closure leads 82, 84) (FIG. 1D) to seal the package 100. The first and second finish leads 122, 124 extends in a helical fashion as shown best in FIG. 3B. Each of the first and second finish leads 122, 124 is discontinuous.

In another embodiment, the first positions of the first and second finish leads 122, 124 are located roughly 180 degrees apart from each other and, thus, begin on opposing sides of the neck portion 102 of the container 108. When opening the container, a first closure lead is desirably in contact with the first finish lead and the second closure lead is desirably in contact with the second finish lead. It is contemplated that the external helical thread formation of the container may have discontinuous leads. It is contemplated that the external helical thread formation of the container may be different than depicted in FIG. 3B.

The container 108 includes the plurality of ratchet catch lugs 116 being located on the exterior surface 102*a* of the neck portion 102. As shown best in FIG. 3B, the plurality of ratchet catch lugs 116 is located between the A-collar 106 and the circumferential bead 110. In this embodiment, the plurality of ratchet catch lugs 116 remains at the same distance from the opening 114 of the container 108. The plurality of ratchet catch lugs 116 is located further from the opening 114 of the container 108 than the external helical thread formation 104.

The plurality of ratchet catch lugs 116, as discussed above, work in conjunction with the plurality of helical ratchet teeth threads 66 to lock the container so as to prevent or inhibit the one-piece polymeric closure 10 from being removed from the container 108. Specifically, at least one of the plurality of ratchet catch lugs 116 of the container 108 is configured to mechanically catch and lock with a respective one of the plurality of helical ratchet teeth threads 66 during application of the closure 10 onto the container 108, which creates an irreversible lock. Thus, a user cannot unscrew the polymeric closure 10 from the neck portion or finish 102 of the container 108 to gain access to the contents therein. The locking of the plurality of ratchet catch lugs 116 and the plurality of helical ratchet teeth threads 66 is shown in FIG. 4H.

The ratchet catch lugs 116 includes a plurality of angled projections 118 that are spaced from each other. As shown best in FIG. 4H, the angled projections 118 are in a general shape of circular saw blades. The ratchet catch lugs 116 are shown in a first set 120*a* and a second set 120*b* that are located on generally opposing sides of the neck portion 102. Thus, in this embodiment, the plurality of ratchet catch lugs 116 extends around a portion of the circumference of the container 108. Each of the ratchet catch lugs 116 of the first and second sets 120*a*, 120*b* include 11 angled projections 118 that are spaced apart from each other.

It is contemplated that the number of angled projections in the ratchet catch lugs may vary from that depicted in FIGS. 3B, 4H. It is also contemplated that the number of angled projections in the ratchet catch lugs may be different in the first and second sets. It is also contemplated that the number of sets of ratchet catch lug sets may vary from a plurality of ratchet catch lugs to exactly one ratchet catch lug set.

In another embodiment, it is contemplated that other polymeric closures that can be opened without unthreading the closure may be used instead of the polymeric closure 10. For example, a one-piece polymeric closure 210 may be used instead of the polymeric closure 10 that includes a double-sided wall structure. The polymeric closure 210 is a single-walled structure and is shown in a cross-sectional view. The polymeric closure 210 may be used with the container 108 described above. Specifically, the polymeric closure 210 includes a first closure portion or lid 212 and a second closure portion or base 214. The first closure portion 212 includes a polymeric top wall portion 222. The second closure portion 214 includes a polymeric annular skirt portion 224, an internal helical thread formation 280 and a plurality of helical ratchet teeth threads 266*a*, 266*b*. The plurality of helical ratchet teeth threads 266*a*, 266*b* of the polymeric closure 210 are identical to and function the same as the plurality of helical ratchet teeth threads 66 of the polymeric closure 10 described above.

The closures of the present invention may include an oxygen-scavenger material. This oxygen-scavenger material may be distributed within the closure or may be a separate layer. The oxygen-scavenger material may be any material that assists in removing oxygen within the container, while having little or no effect on the contents within the container.

Alternatively, or in addition to, the closures may include an oxygen-barrier material. The oxygen-barrier material may be added as a separate layer or may be integrated within the closure itself. The oxygen-barrier materials assist in preventing or inhibiting oxygen from entering the container through the closure. These materials may include, but are not limited to, ethylene vinyl alcohol (EVOH). It is contemplated that other oxygen-barrier materials may be used in the closure.

Additionally, it is contemplated that other features may be included in the closure described above. For example, U.S. Publication No. 2017/0349336, U.S. Pat. Nos. 9,126,726, 8,763,830, 8,485,374, U.S. Publication No. 2009/0045158 and U.S. Pat. No. 6,123,212 all include features that could be incorporated in the closures of the present invention. All of these references are hereby incorporated by reference in their entireties.

The polymeric closure 10 is typically made of an polyolefin (e.g., polyethylene (PE), polypropylene (PP)) or blends thereof. One example of a polyethylene that may be used is high density polyethylene (HDPE), low density polyethylene (LDPE) or the combination thereof. It is contemplated that the closure may be made of other polymeric materials.

The polymeric closure is typically light weight. The polymeric closure is generally from about 8 to about 30 grams and typically is from about 8 to about 20 grams. In other embodiments, the polymeric closure is from about 10 to about 17 grams, or from about 12 to about 17 grams. The polymeric closure in a further embodiment is from about 8 to about 15 grams, or from about 10 to about 15 grams.

The polymeric closures are typically formed by processes such as injection or compression molding.

The container 108 is typically made of polymeric material. One non-limiting example of a material to be used in forming a polymeric container is polyethylene terephthalate (PET), polypropylene (PP) or blends using the same. It is contemplated that the container may be formed of other polymeric or copolymer materials. It is also contemplated that the container may be formed of glass. The container 108 typically has an encapsulated oxygen-barrier layer or oxygen barrier material incorporated therein.

In one method to open the container 108 and gain access to the product therein, the first closure portion 12 is initially flipped with respect to the second closure portion 14 using the hinge 38. Referring to FIG. 1E, a user will grasp the lift extension 36 and pull upwardly (in the direction of Arrow B) and then outwardly (in the direction of arrow C) to the open position. This will allow the first closure portion 12 to slip past the second closure portion 14. FIG. 4D shows the polymeric closure 10 and the container 108 after the flipping has been completed. It is desirable for the first closure portion 12 to flip or rotate at least about 125 degrees or even more desirably at least 135 or at least 150 degrees from a closed position to an open position until being locked.

The hinge 38 as shown best in FIGS. 1, 2A, 2B is continuous and is one integral component. It is contemplated that the hinge may be a plurality of hinges in another embodiment to assist in moving the first closure portion and the second closure portion with respect to each other.

The polymeric closures of the present invention are desirable in both low-temperature and high-temperature applications. The polymeric closures may be used in low-temperature applications such as an ambient or a cold fill. These applications include aseptic applications such as dairy products, water, sports drinks, and pressurized products such as carbonated soft drinks. It is contemplated that other low-temperature applications may be used with the polymeric closures formed by the processes of the present invention.

The polymeric closures of the present invention may be exposed to high-temperature applications such as hot-fill, pasteurization, and retort applications. A hot fill application is generally performed at temperatures around 185° F., while a hot-fill with pasteurization is generally performed at temperatures around 205° F. Retort applications are typically done at temperatures greater than 250° F. It is contemplated that the polymeric closures of the present invention can be used in other high-temperature applications.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention.

What is claimed is:

1. A package comprising:

a container having a neck portion defining an opening, the neck portion having an exterior surface and an interior surface, the container further including an external helical thread formation and a plurality of ratchet catch lugs being located on the exterior surface of the neck portion, the plurality of ratchet catch lugs being located further from the opening of the container than the external helical thread formation; and a one-piece closure being configured for fitment to the neck portion of the container for closing the opening, the closure including a first closure portion and a second closure portion, the closure comprising a polymeric top wall portion and a polymeric annular skirt portion, the polymeric annular skirt portion depending from the polymeric top wall portion, the polymeric annular skirt portion including an internal helical thread formation for mating engagement with the external helical thread formation of the container, an interior surface of the polymeric annular skirt portion including a plurality of helical ratchet teeth threads, the plurality of helical ratchet teeth threads being located farther from the polymeric top wall portion than the internal helical thread formation, wherein at least one of the plurality of ratchet catch lugs of the container is configured to mechanically catch and lock with a respective one of the plurality of helical ratchet teeth threads so as to prevent or inhibit the closure from being removed from the container, wherein the polymeric closure is adapted to be opened by flipping the first closure portion with respect to the second closure portion via a hinge, wherein each of the plurality of ratchet catch lugs is located at the same distance from the opening of the container.

2. The package of claim 1, wherein the container further includes an A-collar, the plurality of ratchet catch lugs being located farther from the opening of the neck portion than the A-collar.

3. The package of claim 1, wherein the plurality of ratchet catch lugs extends around a portion of a circumference of the container.

4. The package of claim 3, wherein the plurality of ratchet catch lugs includes a first set and a second set, the first and second sets being on opposite portions of the circumference of the container.

5. The package of claim 1, wherein each of the plurality of helical ratchet teeth threads is an angled serrated shape.

6. The package of claim 5, wherein the plurality of helical ratchet teeth threads is angled toward rotation of threading occurring between the external helical thread formation of the container and the internal helical thread formation of the closure.

7. The package of claim 1, wherein each of the plurality of helical ratchet teeth threads is angled from about 5 to about 45 degrees.

8. The package of claim 7, wherein each of the plurality of helical ratchet teeth threads is angled from about 20 to about 35 degrees.

9. The package of claim 1, wherein a helical pitch of the plurality of helical ratchet teeth threads is from about 1 to about 15 degrees.

10. The package of claim 9, wherein the helical pitch of the plurality of helical ratchet teeth threads is from about 3 to about 7 degrees.

11. The package of claim 1, wherein a helical pitch of the plurality of helical ratchet teeth threads and a helical pitch of the external helical thread formation are within about 1.5 degrees of each other.

12. The package of claim 11, wherein the helical pitch of the plurality of helical ratchet teeth threads and the helical pitch of the external helical thread formation are within about 1.0 degrees of each other.

13. The package of claim 12, wherein the helical pitch of the plurality of helical ratchet teeth threads and the helical pitch of the external helical thread formation are within about 0.5 degrees of each other.

14. The package of claim 12, wherein the helical pitch of the plurality of helical ratchet teeth threads, the helical pitch of the external helical thread formation, and a helical pitch of the internal helical thread formation are within about 1.0 degrees of each other.

15. The package of claim 14, wherein the helical pitch of the plurality of helical ratchet teeth threads, the helical pitch of the external helical thread formation, and the helical pitch of the internal helical thread formation are within about 0.5 degrees of each other.

16. A package comprising:

a container having a neck portion defining an opening, the neck portion having an exterior surface and an interior surface, the container further including an external helical thread formation and a plurality of ratchet catch lugs being located on the exterior surface of the neck portion, the plurality of ratchet catch lugs being located further from the opening of the container than the external helical thread formation; and a one-piece closure being configured for fitment to the neck portion of the container for closing the opening, the closure comprising a first closure portion and a second closure portion, the first closure portion including a first polymeric top wall portion and a first polymeric annular skirt portion, the first polymeric annular skirt portion depending from the first polymeric top wall portion, the second closure portion including a second polymeric top wall portion and a second polymeric annular skirt portion depending from the second polymeric top wall portion, the second polymeric top wall portion including a removable pull ring, the second polymeric annular skirt portion including an internal helical thread formation for mating engagement with the external helical thread formation of the container, an interior surface of the second polymeric annular skirt portion including a plurality of helical ratchet teeth threads, the plurality of helical ratchet teeth threads being located farther from the second polymeric top wall portion than the internal helical thread formation, wherein at least one of the plurality of ratchet catch lugs of the container is configured to mechanically catch and lock with a respective one of the plurality of helical ratchet teeth threads so as to prevent or inhibit the closure from being removed from the container, wherein the polymeric closure is adapted to be opened by flipping the first closure portion with respect to the second closure portion via a hinge, wherein each of the plurality of ratchet catch lugs is located at the same distance from the opening of the container.

17. The package of claim 16, wherein the first closure portion includes a removable pull ring.

18. The package of claim 16, wherein each of the plurality of helical ratchet teeth threads is an angled serrated shape.

19. The package of claim 16, wherein a helical pitch of the plurality of helical ratchet teeth threads and a helical pitch of the external helical thread formation are within about 1.5 degrees of each other.

* * * * *